US011083957B2

(12) United States Patent
Swiderski

(10) Patent No.: US 11,083,957 B2
(45) Date of Patent: Aug. 10, 2021

(54) ELECTRONIC TRADING CARD GAME

(71) Applicant: THE UPPER DECK COMPANY, Carlsbad, CA (US)

(72) Inventor: Benjamin Swiderski, Carlsbad, CA (US)

(73) Assignee: THE UPPER DECK COMPANY

( * ) Notice: Subject to any disclaimer, the term of this patent is extended or adjusted under 35 U.S.C. 154(b) by 0 days.

(21) Appl. No.: 16/741,267

(22) Filed: Jan. 13, 2020

(65) Prior Publication Data

US 2020/0230490 A1 Jul. 23, 2020

Related U.S. Application Data

(60) Provisional application No. 62/793,625, filed on Jan. 17, 2019.

(51) Int. Cl.

| | |
|---|---|
| ***A63F 1/04*** | (2006.01) |
| ***A63F 9/24*** | (2006.01) |
| *A63F 11/00* | (2006.01) |
| *A63F 1/00* | (2006.01) |

(52) U.S. Cl.

CPC ..... *A63F 1/04* (2013.01); *A63F 9/24* (2013.01); *A63F 2001/008* (2013.01); *A63F 2001/0408* (2013.01); *A63F 2001/0416* (2013.01); *A63F 2001/0458* (2013.01); *A63F 2001/0475* (2013.01); *A63F 2011/0086* (2013.01); *A63F 2300/807* (2013.01)

(58) Field of Classification Search

CPC ..... A63F 2001/008; A63F 2001/0408; A63F 2001/0416; A63F 2001/0458; A63F 2001/0475; A63F 2011/0086; A63F 2300/807

USPC ..... 273/292, 302, 303, 308; 463/9

See application file for complete search history.

(56) References Cited

U.S. PATENT DOCUMENTS

| | | | | |
|---|---|---|---|---|
| 5,467,997 | A * | 11/1995 | Bashirzadeh | A63F 1/00 273/302 |
| 5,662,332 | A * | 9/1997 | Garfield | A63F 1/00 273/308 |
| 2002/0040929 | A1* | 4/2002 | Bramucci | A63F 1/04 235/435 |
| 2002/0043764 | A1* | 4/2002 | Imhof | A63F 1/00 273/292 |

(Continued)

*Primary Examiner* — Benjamin Layno

(74) *Attorney, Agent, or Firm* — Roeder & Broder LLP; Steven G. Roeder

(57) ABSTRACT

A method for competing in game play of an electronic trading card game within a game host between a first player and a second player includes (i) each player receiving an unopened pack of trading cards; (ii) opening the pack of trading cards for each player to reveal individual trading cards for each player only to the respective player; (iii) selecting a plurality of statistical categories that are shown to each player; (iv) each player assigning one of the individual trading cards from their respective pack of trading cards to each statistical category; (v) comparing a relevant statistic included on each of the individual trading cards for each player that has been assigned to each statistical category; and (vi) determining a winner for each statistical category based on which of the individual trading cards assigned to that statistical category has the best relevant statistic.

9 Claims, 7 Drawing Sheets

(56) References Cited

U.S. PATENT DOCUMENTS

| | | | | |
|---|---|---|---|---|
| 2005/0151320 | A1* | 7/2005 | Gress | A63F 1/00 273/292 |
| 2013/0281173 | A1* | 10/2013 | Gilson | A63F 13/40 463/11 |
| 2018/0028900 | A1* | 2/2018 | Montecillo | A63F 1/00 |

* cited by examiner

ELECTRONIC TRADING CARD GAME

RELATED APPLICATION

This application claims priority on U.S. Provisional Patent Application Ser. No. 62/793,625, entitled "ELECTRONIC TRADING CARD GAME", filed on Jan. 17, 2019. As far as permitted, the contents of U.S. Provisional Patent Application Ser. No. 62/793,625 are incorporated in their entirety herein by reference.

BACKGROUND

All around the world there are various types of collectible items that people like to collect and trade. For example, trading cards are a popular way to collect images and information about athletes, movies, television shows, events, historical and public figures, and celebrities. The traditional method of adding cards to one's collection is to drive to a store and purchase one or more packs of trading cards (also referred to herein as "card packs"). A pack of trading cards in this context includes one or more trading cards. Subsequently, after opening the one or more card packs, the collector can then store, trade, sell, display, or play games with any of the trading cards that they have acquired. Recently, more and more collectors have moved to obtaining trading cards electronically, e.g., on a computing device.

Certain games that may be played with trading cards involve comparing statistics in various categories that are listed on the trading cards. With such games, there is a continuing desire to make such games more exciting and user-friendly for the players.

SUMMARY

The present invention is directed toward a method for competing in game play of an electronic trading card game between a first player and a second player. The electronic trading card game is provided within a game host including a processor. The first player and the second player each use a respective computing device to access the electronic trading card game within the game host. In various embodiments, the method includes the steps of (i) each of the first player and the second player receiving an unopened pack of trading cards via the game host; (ii) opening the pack of trading cards for each of the first player and the second player within the game host to reveal individual trading cards from the pack of trading cards for each player only to the respective player; (iii) selecting a plurality of statistical categories within the game host that are shown to each of the first player and the second player; (iv) each of the first player and the second player assigning one of the individual trading cards from their respective pack of trading cards to each of the plurality of statistical categories that have been selected within the game host; (v) comparing a relevant statistic included on each of the individual trading cards for each player that has been assigned to each of the plurality of statistical categories within the game host, the relevant statistic for each of the individual trading cards being relevant to the statistical category to which the individual trading card has been assigned; and (vi) determining a winner for each of the plurality of statistical categories within the game host based on which of the individual trading cards assigned to that statistical category has the best relevant statistic.

In some embodiments, the method further includes the step of determining an overall winner within the game host based on which player wins a greater number of statistical categories. In such embodiments, the method can further include the steps of allowing the overall winner to retain their respective pack of trading cards and awarding the overall winner a bonus reward, e.g., a bonus insert card or another suitable reward or product; and allowing the player who is not the overall winner to retain their respective pack of trading cards.

Additionally, in certain such embodiments, if each of the first player and the second player have won the same number of statistical categories, the method further includes the steps of (i) selecting an additional statistical category within the game host that is shown to each of the first player and the second player; (ii) each of the first player and the second player assigning one of the individual trading cards from their respective pack of trading cards to the additional statistical category that has been selected within the game host; (iii) comparing a relevant statistic included on each of the individual trading cards for each player that has been assigned to the additional statistical category within the game host, the relevant statistic for each of the individual trading cards being relevant to the additional statistical category; and (iv) determining a winner for the additional statistical category within the game host based on which of the individual trading cards assigned to the additional statistical category has the best relevant statistic. In such embodiment, the method can further include the step of determining the overall winner within the game host based on which player wins the additional statistical category.

In one embodiment, the electronic trading card game provided within the game host is accessible to the first player and the second player via a computing device application.

In some embodiments, the step of selecting a plurality of statistical categories can include randomly selecting the plurality of statistical categories with the game host.

In certain embodiments, the step of each of the first player and the second player assigning includes each of the individual trading cards of the first player and the second player being assignable to only one of the plurality of statistical categories during game play of the electronic trading card game.

Additionally, in some embodiments, the step of each of the first player and the second player assigning includes each of the first player and the second player assigning one of the individual trading cards from their respective pack of trading cards to each of the plurality of statistical categories within a predetermined period of time. In certain such embodiments, if either of the first player or the second player fails to assign one of the individual trading cards from their respective pack of trading cards to each of the plurality of statistical categories within the predetermined period of time, the method further includes the game host assigning one of the individual trading cards from the pack of trading cards of such player to each of the plurality of statistical categories.

Further, in certain embodiments, the game host includes one of an interactive website and an app.

In some applications, the present invention is further directed toward an electronic trading card game that is usable for competing in game play between a first player and a second player, the electronic trading card game including a game host that is accessible to the first player and the second player using a respective computing device via a computing device application, the game host including a processor that is configured to perform the following steps:

(A) providing each of the first player and the second player an unopened pack of trading cards; (B) opening the pack of trading cards for each of the first player and the second player to reveal individual trading cards from the pack of trading cards for each player only to the respective player; (C) selecting a plurality of statistical categories that are shown to each of the first player and the second player; (D) allowing each of the first player and the second player to assign one of the individual trading cards from their respective pack of trading cards to each of the plurality of statistical categories that have been selected; (E) comparing a relevant statistic included on each of the individual trading cards for each player that has been assigned to each of the plurality of statistical categories, the relevant statistic for each of the individual trading cards being relevant to the statistical category to which the individual trading card has been assigned; and (F) determining a winner for each of the plurality of statistical categories based on which of the individual trading cards assigned to that statistical category has the best relevant statistic.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
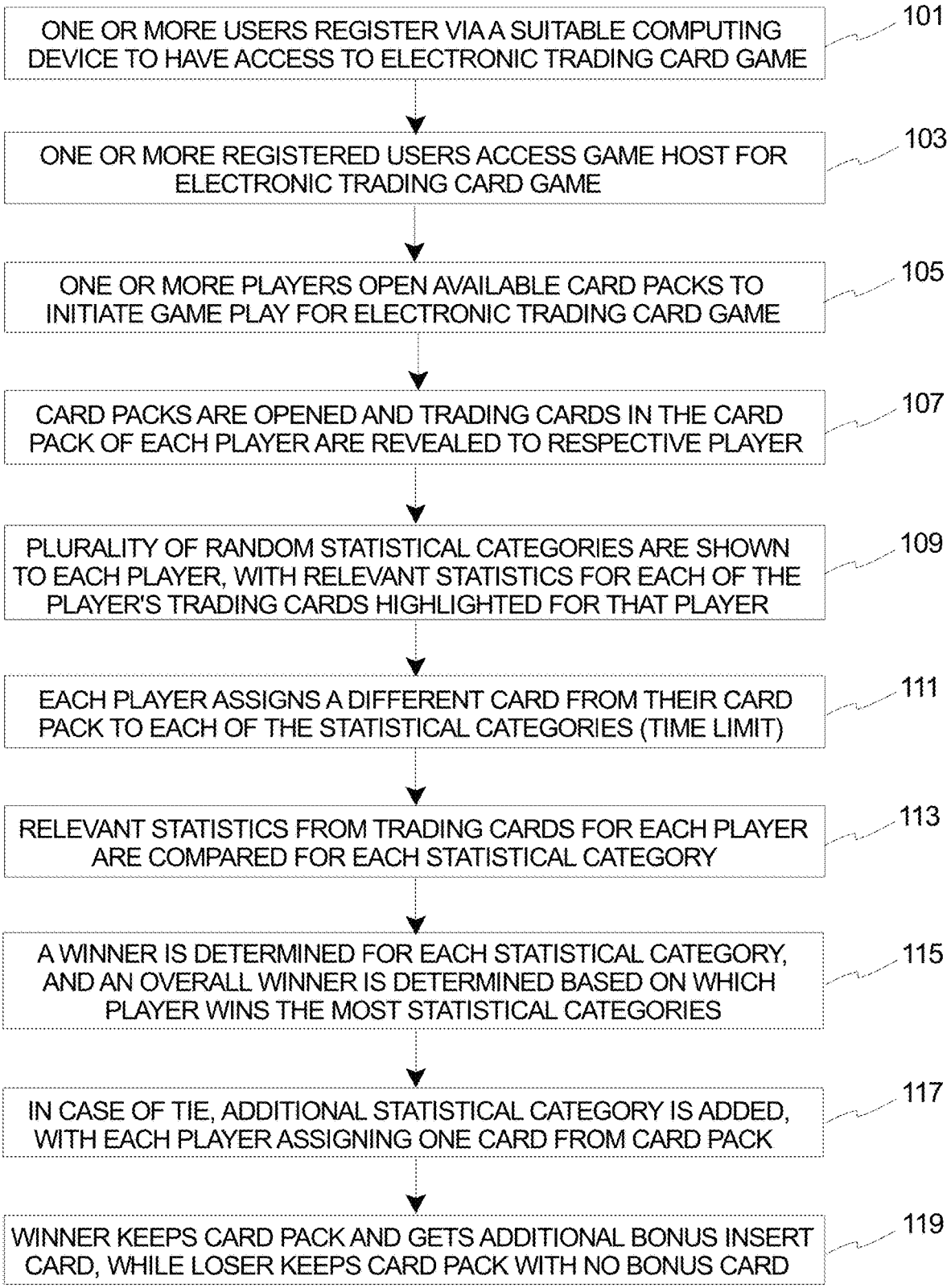
FIG. 1 is a flowchart illustrating a representative embodiment of the process for registering for, accessing, and competing in game play of an electronic trading card game having features of the present invention.

Embodiments of the present invention are described herein in the context of an electronic trading card game that can be played by one or more users (also sometimes referred to herein as "players"). In particular, as provided in detail herein, the electronic trading card game is an online peer-to-peer (P2P) and/or peer-to-computer (P2C) game where the users, or players, each buy (or otherwise receive) and open an electronic pack of trading cards, and compare random statistical categories that are relevant to and/or provided on each of the electronic trading cards within the electronic pack of trading cards. Thus, as provided herein, the electronic trading card game of the present invention is typically played using a previously unopened electronic pack of trading cards.

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

As utilized herein, the term "trading card" means a card containing various subject matters and pictures, materials, autographs, designs, and/or other unique elements, which is intended to be collected and traded. Additionally, the trading cards utilized within the present invention will also necessarily include one or more statistics relevant to the subject of the individual trading card (also referred to herein generally as "relevant statistics"). For example, when the trading cards are related to a particular sport, the relevant statistics can include statistics that are compiled for that particular sport. In one non-exclusive alternative embodiment, the relevant statistics for a basketball trading card can include one or more of games played, minutes played, points scored, shooting percentage, rebounds, assists, blocked shots, steals, etc. Additionally and/or alternatively, the relevant statistics can relate to the height (tallest or shortest), weight (heaviest or lightest) and age (oldest or youngest) of the individual depicted on the individual trading card. Further, in another non-exclusive embodiment, in entertainment-related trading cards, e.g., related to movies, television shows, celebrities, etc., the relevant statistics can relate to the number of awards won in a particular category, number of movies or shows acted in, number of records released, or any other relevant statistics for the given category of trading cards. It is appreciated, however, that these are merely examples of the relevant statistics that can be utilized within any given competing of the electronic trading card game, and the relevant statistics can be any statistics that can relate to the subject(s) of the individual trading cards.

Additionally, it is understood that an individual trading card is usually part of a set of somewhat similar cards packaged in a card pack or other container. However, it is further appreciated that a card pack, as referred to herein, can include a single trading card or multiple trading cards.

Various embodiments, and multiple variations of the electronic trading card game will be described in detail herein.

FIG. 1 is a flowchart illustrating a representative embodiment of the process for registering for, accessing, and competing in game play of an electronic trading card game having features of the present invention. As described in detail herein, registering for, accessing, and competing in game play of the electronic trading card game can include a plurality of steps that are undertaken using at least one computing device. It is understood that the various steps described herein can be modified as necessary during the play of the electronic trading card game. Additionally, it should also be appreciated that in certain applications the order of the steps can be modified, certain steps can be omitted, and/or additional steps can be added without limiting the intended scope and breadth of the present invention.

Initially, at step 101, one or more users can register with a game host to be able to access, use and compete in the playing of the electronic trading card game, thus becoming registered users. The users can register for the electronic trading card game using any suitable computing device. Additionally, as provided herein, the electronic trading card game can be said to be accessible via any suitable computing device application. For example, in certain embodiments, the electronic trading card game can be provided via an interactive website that is accessible to the users via a desktop computer, a laptop computer, a tablet, a smartphone, or another suitable computing device. Additionally, or in the alternative, the electronic trading card game can be provided via an application or "app" that is accessible via a tablet or smartphone.

As part of the registration process, in various embodiments, the users may be required to provide and/or establish any suitable credentials to ensure that only registered users can access and compete in the electronic trading card game. For example, in certain non-exclusive embodiments, the users may be required to provide a name and contact information (e.g., email address or phone number), and to further establish a user id and password for subsequently accessing the electronic trading card game. Alternatively, the prospective players of the electronic trading card game may be required to provide other suitable credentials. Still alternatively, in some embodiments, the prospective users can be allowed to access the electronic trading card game as a "guest", i.e. without necessarily providing any particular credentials. In certain such embodiments, access to the electronic trading card game as a "guest" may have a limited duration, i.e. may be limited to only a certain predetermined trial period.

Figure 2:
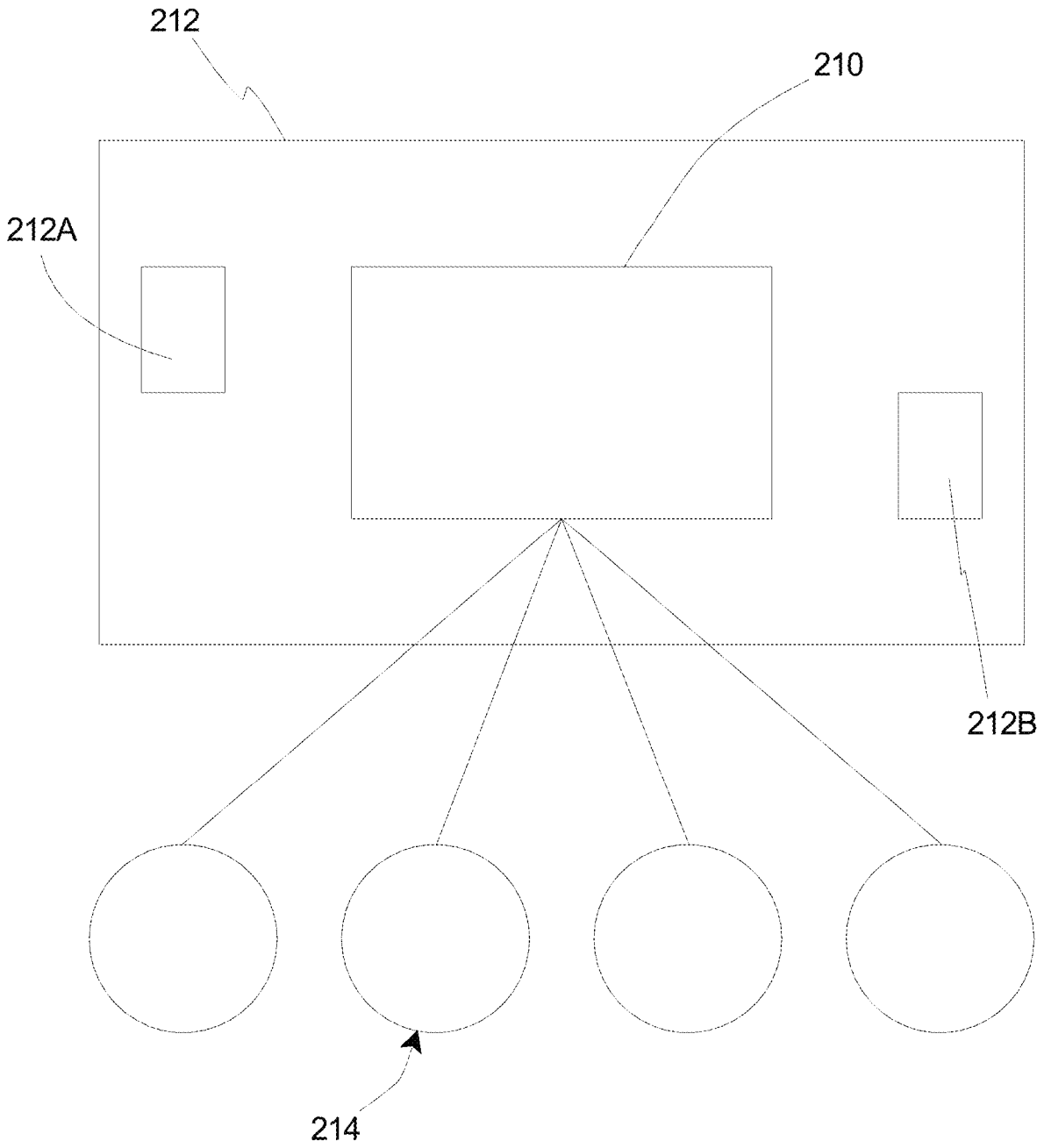
FIG. 2 is a simplified schematic view illustration of an embodiment of the electronic trading card game that is provided within a computing device, and a plurality of users that can register for, access, and compete in game play of the electronic trading card game.

FIG. 2 is a simplified schematic view illustration of an embodiment of an electronic trading card game 210 having features of the present invention that is provided within a game host 212, and a plurality of users 214 (or "players", illustrated as a plurality of circles) that can access and participate in game play of the electronic trading card game 210. It is appreciated that the electronic trading card game 210 can be accessed and played by any number of users 214; although it is further appreciated that each individual game play or competition of the electronic trading card game 210 is typically limited to two players 214. However, in certain alternative embodiments, more than two players 214 can participate in any individual competition of the electronic trading card game 210. Still alternatively, a single player 214 can compete against an automated user that is available within the electronic trading card game itself, while participating in an individual competition of the electronic trading card game 210. In such embodiments where a live player 214 is competing against an automated player, or computer player, game play of the electronic trading card game 210 can still be said to occur between two players 214, i.e. a first player 214 and a second player 214. Thus, as referred to herein, the electronic trading card game 210 is typically configured for play between at least two players 214.

The game host 212 on which the electronic trading card game 210 can be accessed by the players 214 can be and/or can be included within any suitable type of computing device. Additionally, the game host 212 can be provided to the players 214 in any suitable format. For example, in certain non-exclusive embodiments, the game host 212 can include a server, an interactive website, a standalone gaming system, an app, or another suitable format. Additionally, as utilized and described herein, the game host 212 can include one or more processors 212A (illustrated as a box in FIG. 2) or circuits that enable the various functions and procedures described in detail herein. Additionally, the game host 212 can further include an electronic storage device 212B (illustrated as a box in FIG. 2) for storing any relevant information for purposes of carrying out various steps in the process described herein.

As an overview, in certain embodiments, as provided in detail herein, the electronic trading card game 210 is an online peer-to-peer and/or peer-to-computer game where the players 214 each buy or otherwise receive and open an electronic pack of trading cards 320 (illustrated, for example, in FIG. 3, and sometimes referred to herein simply as a "card pack") via the game host 212. Upon opening the card pack 320, the individual trading cards 622 (illustrated in FIG. 6) from the corresponding card pack 320 of each player 214 are revealed to the respective player 214, but not to the other player 214, and a selection of random statistical categories 724 (illustrated in FIG. 7) are then displayed to each of the players 214. Stated in another fashion, each respective player 214 is now able to view only the individual trading cards 622 in their own card pack 320.

The players 214 then review the statistics shown for each individual trading card 622 in their card pack 320 and assign one trading card 622 from their card pack 320 to each of the displayed statistical categories 724 in that particular game. The relevant statistics on the selected trading cards 622 for each of the players 214 are then compared for each statistical category 724 within the game host 212 and as displayed on each individual player's computing device, and a winner is declared based on which player 214 wins the most statistical categories 724. In certain embodiments, if a player 214 wins their game, the player 214 keeps the trading cards 622 in their card pack 320 and is awarded a bonus reward, e.g., an additional insert (bonus) card 1126 (illustrated in FIG. 11) that is determined randomly, or another suitable reward or product. In such embodiments, if a player 214 loses their game, the player 214 keeps the trading cards 622 in their card pack 320, but is not awarded a bonus reward.

Returning back to FIG. 1, at step 103, one or more of the registered users can access the game host, e.g., with a suitable computing device, which is specifically configured to host the electronic trading card game. In certain embodiments, the registered users are required to enter user id and password information (or other credentials) each time they access the game host. Alternatively, in some situations, the registered users may be able to access the game host without entering one or both of their user id and password.

Although it is assumed that the primary purpose for the registered users accessing the game host is to participate in a competition of the electronic trading card game; as provided herein, the registered users can access the game host for other reasons as well. Initial access to the game host will typically be provided in the form of a home page (or "game lobby") that can provide various features and opportunities for the registered users. Some such features and opportunities that may be provided to the registered users within embodiments of the home page or game lobby are illustrated in FIG. 3.

Figure 3:
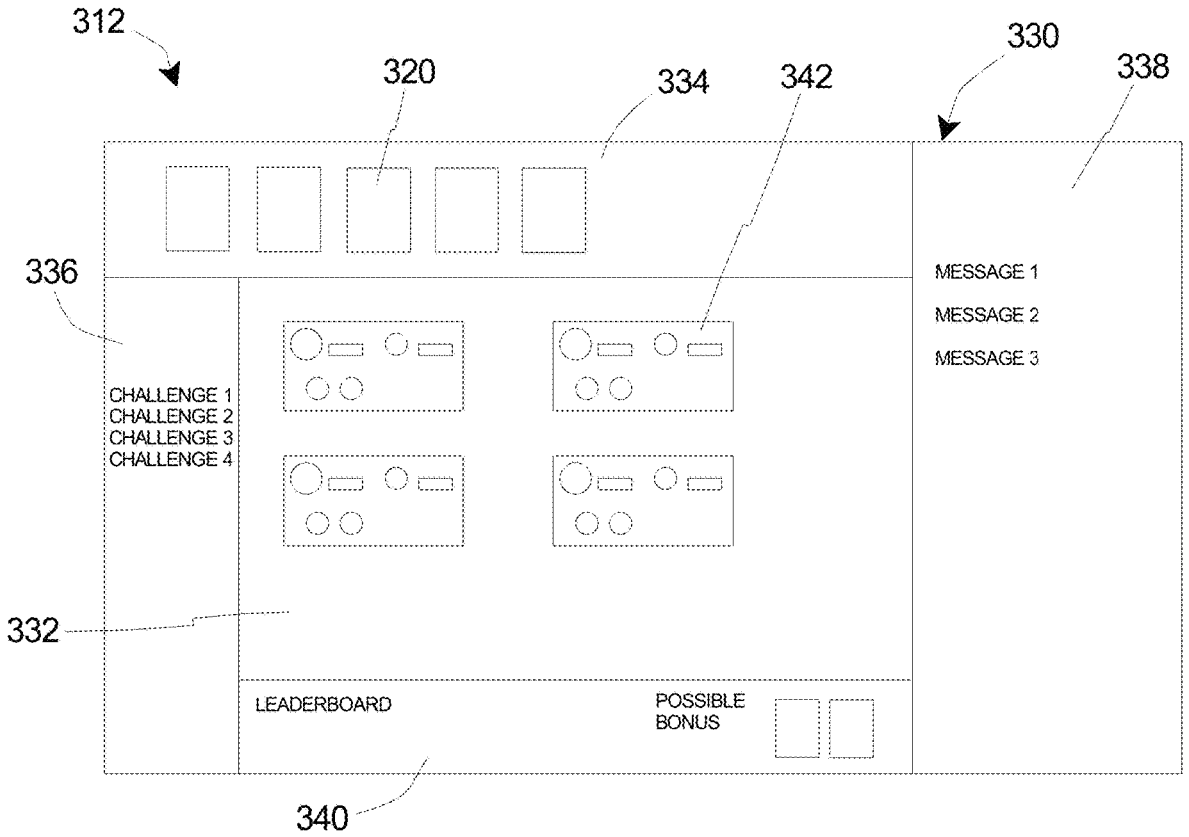
FIG. 3 is a simplified schematic view illustration of an embodiment of a home page that can be included as part of a game host for the electronic trading card game.

In particular, FIG. 3 is a simplified schematic view illustration of an embodiment of a home page 330 (also sometimes referred to herein as a "game lobby") that can be included as part of a game host 312 for the electronic trading card game 210 (illustrated in FIG. 2). The design of the game lobby 330 can be varied to suit the particular requirements of the electronic trading card game 210. In certain embodiments, as shown in FIG. 3, the game lobby 330 can include one or more of a user zone 332, an available trading card pack zone 334 (also sometimes referred to herein simply as a "pack zone"), a challenge zone 336, a chat zone 338, and an update zone 340. Alternatively, the game lobby 330 can include additional components (or zones) or fewer components (or zones) than those specifically illustrated and described in FIG. 3. Additionally, it is appreciated that although FIG. 3 illustrates the zones of the game lobby 330 in a particular position, sequence and/or order, these zones can be located in any suitably different position, sequence and/or order than that illustrated in FIG. 3. Further, as illustrated and described herein, each of the zones 332, 334, 336, 338, 340 of the game lobby 330 are configured to contain various features and components. However, it is appreciated that any of the noted features and components can also or alternatively be positioned and/or utilized within any of the other zones 332, 334, 336, 338, 340 of the game lobby 330.

As shown in FIG. 3, the user zone 332 includes one or more user cards 342. The user cards 342 provide a graphical display or listing of all available players 214 (illustrated in FIG. 2) that are logged into and accessing the electronic trading card game 210, e.g., the game host 312, at that time. Stated in another manner, the user zone 332 displays the available players 214 against whom the individual accessing the electronic trading card game 210 can compete in an individual playing of the electronic trading card game 210 at that time. For example, in FIG. 3, four user cards 342 are illustrated, which indicates that four players 214 are available to compete in a present playing of the electronic trading card game 210. It is appreciated that the showing of only four user cards 342 is merely for purposes of simplicity and ease of illustration, and that at any given time the game lobby 330 can be accessed by many more players 214 that wish to and thus are able to compete in game play of the electronic trading card game 210.

Further, in some embodiments, in the event that no other live players 214 are currently available to compete in game play of the electronic trading card game 210 with a given player 214, if the player 214 so desires, the game host 312 itself can compete against that player 214 in game play of the electronic trading card game 210. In such situation, the player 214 would know that they are playing against the game host 312, i.e. against a computer. During such game play, as described in detail below, the game host 312 will make all appropriate decisions that would have been otherwise made by the individual opposing player 214.

The pack zone 334 illustrates the number and types of available trading card packs 320 of a particular player 214 for potential use in a playing of the electronic trading card game 210. In some embodiments, only specifically designated card packs 320, i.e. designated within the game host 312, are available for potential use in game play of the electronic trading card game 210. Additionally, in various embodiments, an available trading card pack 320 is a trading card pack 320 that has been purchased and/or received by the player 214 from or within the game host 312, but which has not yet been opened by the player 214. Stated in another manner, the available trading card packs 320 are "blind packs" or "unopened packs" as the player 214 does not know the specific contents of the trading card pack 320 before a playing of the electronic trading card game 210 is initiated. With such design, the mystery and excitement in the electronic trading card game 210 can be enhanced as the users/players 214 do not know what cards they may have available to use in any given playing of the electronic trading card game 210. Conversely, in some more traditional pack wars games, the players already know and/or specifically choose what trading cards to be used in any given game; thus allowing them to attempt to "stack the deck" in their favor. Thus, the present invention can provide a more level playing field for the users 214 than such traditional pack wars games, which can lead to greater anticipation and excitement for the users 214 during game play of the electronic trading card game 210.

It is appreciated that the available trading card packs 320 can be provided in many different types, and it is generally preferred that individual competitions occur between players 214 having the same type of available trading card packs 320. For example, the different types of available trading card packs 320 can include card packs 320 with different numbers of trading cards 622 (illustrated in FIG. 6), card packs 320 with different qualities of trading cards 622 (e.g., offering more unique or rare trading cards 622), and card packs 320 that include trading cards 622 for different sports or different categories (e.g., sports, movies, celebrities, etc.).

Additionally, it is further appreciated that in certain embodiments, an individual game play of the electronic trading card game can be initiated simply by one or more users 214 purchasing and/or receiving an unopened card pack 320, which can then be electronically opened substantially simultaneously at the outset of the game play.

The challenge zone 336 is a zone within the game lobby 330 that is used to show the user 214 any specific and direct challenges that have been made to that user 214, sent by that user 214, as well any random challenges the user 214 is paired to. Additionally, as provided herein, a user 214 can see on a user card 342 (i.e. within the user zone 332) if any other users 214 have specifically opened themselves up to presently receiving and accepting challenges from other users 214. Further, in some embodiments, a toggle in the card pack zone 334 enables the specific user 214 accessing the game host 312 and/or game lobby 330 to make themselves available to accept challenges from other users 214 that have the same type of available card packs 320. Additionally, in some embodiments, the user 214 can allow the game host 312 to randomly match them with another user 214 that wishes to compete in an individual playing of the electronic trading card game 210. Alternatively, in other embodiments, specific or random challenges can be sent, received, accepted or refused in another suitable manner and/or within other suitable zones.

In certain embodiments, the user 214 is specifically notified within the challenge zone 336 when they have received a direct challenge from another user 214. In some such embodiments, the user 214 receiving the direct challenge then has a predetermined period of time, e.g., sixty seconds or another suitable amount of time, within which to accept or decline the challenge. If the user 214 accepts the challenge, the actual game play of the electronic trading card game 210 will commence (such as described in detail herein below). If the user 214 declines the challenge, then the challenge notification will be removed from the challenge zone 336. If the user 214 ignores or otherwise does not respond to the challenge, then the challenge notification will be removed at the expiration of the predetermined amount of time, e.g., at the end of the sixty seconds or other suitable amount of time.

The chat zone 338 is an area where individual users 214 can send messages to and receive messages from any other users 214 that have registered with the electronic trading card game 210. In various embodiments, all messages that are sent within the chat zone 338 can be seen by any and all users that access the game lobby 330. Additionally, or in the alternative, in some embodiments, certain messages sent and received within the chat zone 338 can be specifically directed to particular users 214 or groups of users 214. In certain such alternative embodiments, it is appreciated that any such messages can be directed to other particular users 214 regardless of whether or not the other particular users 214 are accessing the game host 312 at any given time. Still alternatively, certain messages that are sent and received directly between only certain users 214 or groups of users 214 can be seen in other zones within the game lobby 330 or elsewhere within the game host 312.

The update zone 340 is configured to provide updates on various facts and activities that may be relevant to the game host 312 and/or the electronic trading card game 210. For example, the update zone 340 can provide a sortable leaderboard that shows the top win-loss records, top winning percentages, most wins, most games played, etc. from amongst all of the registered users 214 or from amongst a subset of all of the registered users 214, e.g., amongst a group of "friends" as established within the game host 312. Additionally, the update zone 340 can also show upcoming tournaments that any given user 214 may wish to participate in. Further, the update zone 340 may also illustrate any rewards or bonuses (e.g., bonus cards 1126 (illustrated in FIG. 11)) that may be available if a user 214 decides to compete in a playing of the electronic trading card game 210 and/or that have been recently awarded to other users 214. Still further, in some embodiments, the update zone 340 may further include a listing or graphical demonstration of special achievement or bonus awards that may be made available to the players 214 based on playing a certain number of games, winning a certain number of games, winning the most game within a set period of time, etc.

Figure 4:
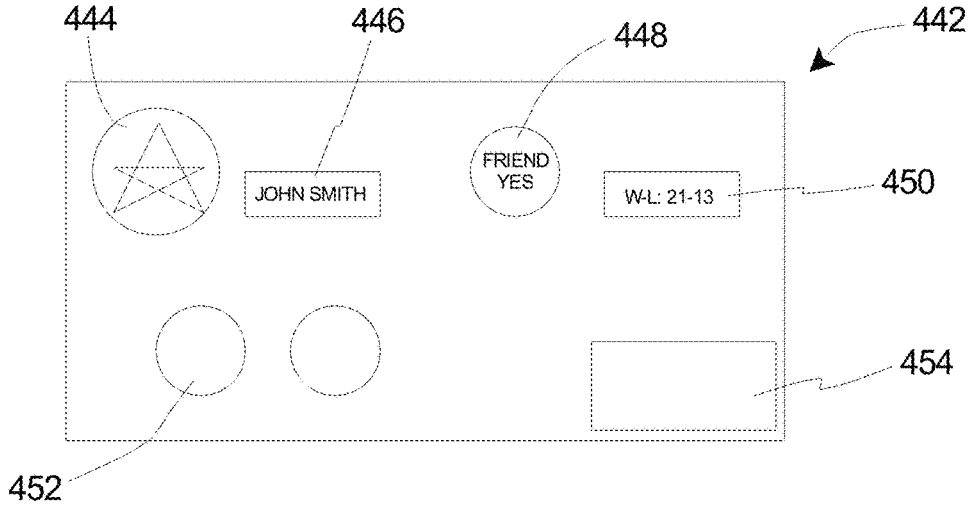
FIG. 4 is a simplified schematic view illustration of an embodiment of a user card that can be included as part of the electronic trading card game.

FIG. 4 is a simplified schematic view illustration of an embodiment of a user card 442 that can be included as part of the electronic trading card game 210 (illustrated in FIG. 2). The individual facts, statistics and components included on the user card 442 can be varied. For example, in some embodiments, the user card 442 can include such features as an avatar 444 for the user, a name 446 of the user, a friend notation 448 as to whether or not the user is a friend of the accessing user, a win-loss record 450 of the user, a pack listing 452 of the availability and type of card packs that user has with which a game may be played, and a challenge indicator 454 of whether or not the user is accepting challenges. Additionally and/or alternatively, the user card 442 can include more features or fewer features than those illustrated and described herein.

Returning again to FIG. 1, at step 105, one or more players can initiate a playing of the electronic trading card game. In particular, an individual playing of the electronic trading card game is typically initiated by the one or more players selecting and opening one of their unopened and available card packs. In some embodiments, as noted herein, an individual live player can compete in game play of the electronic trading card game against a computer player, e.g., the game host. In such embodiments, the computer player is still considered as a player as described herein. Thus, any tasks that may otherwise be performed by a live player can be performed by the computer player.

Figure 5:
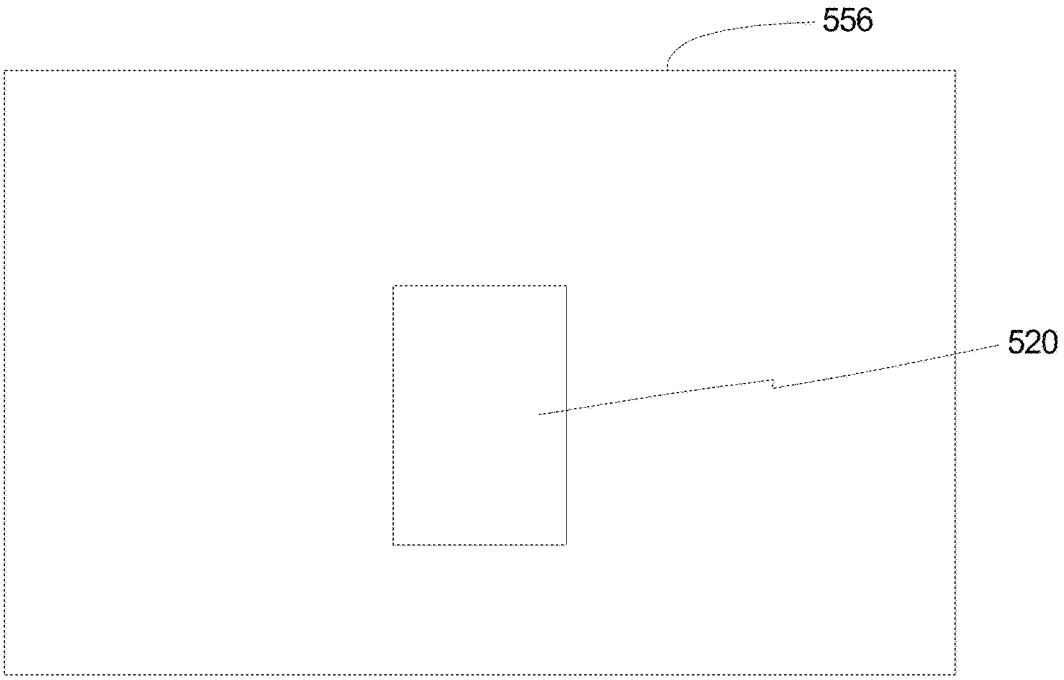
FIG. 5 is a simplified schematic view illustration of a representative screen image that can be used and/or seen by a player during play of the electronic trading card game.

FIG. 5 is a simplified schematic view illustration of a representative screen image 556 that can be used and/or seen by a player 214 (illustrated in FIG. 2) during play of the electronic trading card game 210 (illustrated in FIG. 2). In particular, FIG. 5 is a simplified schematic view illustration of an unopened pack of trading cards 520 for a particular user 214 after a game has been initiated. At this time, with the card pack 520 being unopened, the user 214 does not yet know what trading cards he or she may have in their card pack 520, or what statistical categories will be part of the individual competition.

Returning to FIG. 1, at step 107, the card packs of each player are automatically opened by the game host and the individual trading cards within the card packs are revealed to that player. It is appreciated that in some alternative embodiments, the automatic opening of the card packs can be initiated by a selection of the user, or can be done without specific user initiation so long as the user has previously agreed to take part in specific game play of the electronic trading card game. At this point, the trading cards of each individual player are revealed only to that player and are not revealed to the other player(s) competing in the present playing of the electronic trading card game. Thus, each player can only see their own trading cards from their own card pack at this time.

Figure 6:
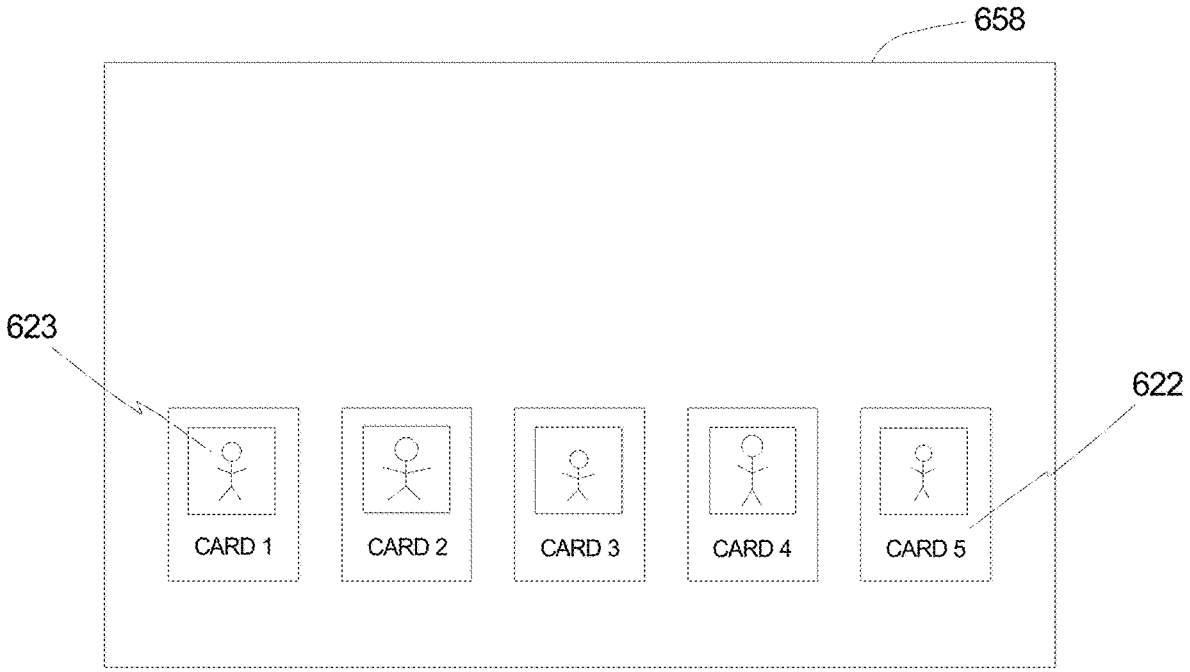
FIG. 6 is a simplified schematic view illustration of another representative screen image that can be used and/or seen by the player during play of the electronic trading card game.

FIG. 6 is a simplified schematic view illustration of another representative screen image 658 that can be used and/or seen by the player 214 (illustrated in FIG. 2) during play of the electronic trading card game 210 (illustrated in FIG. 2). In particular, FIG. 6 is a simplified schematic view illustration of a plurality of individual trading cards 622 from the card pack 520 (illustrated in FIG. 5) that are specifically displayed to the respective user 214 after the game host 312 (illustrated in FIG. 3) has automatically opened the card pack 520. The number of trading cards 622 within the card pack 520 can be varied. Thus, the illustration of five individual trading cards 622 in FIG. 6 is merely a representation of a number of trading cards 622 that may be included in a given card pack 520, and is not meant to be limiting in any manner. It is appreciated that at this point, the individual trading cards 622 of each player 214 are only visible to that particular player 214, and are not visible to the opposing player 214 against whom the player 214 is competing.

Additionally, as shown in FIG. 6, each of the trading cards 622 in the card pack 520 can include an image 623 that relates to the subject of the particular trading card 622. For example, each trading card 622 can include an image 623 of a particular athlete, actor/actress, celebrity, etc. Alternatively, each trading card 622 can include another suitable image that relates to the subject of the particular trading card 622.

Returning once again to FIG. 1, at step 109, a plurality of random statistical categories are selected within and/or by the game host and are shown to each of the players. Additionally, the relevant statistics for each of the player's trading cards can be highlighted or otherwise identified for that individual player.

Figure 7:
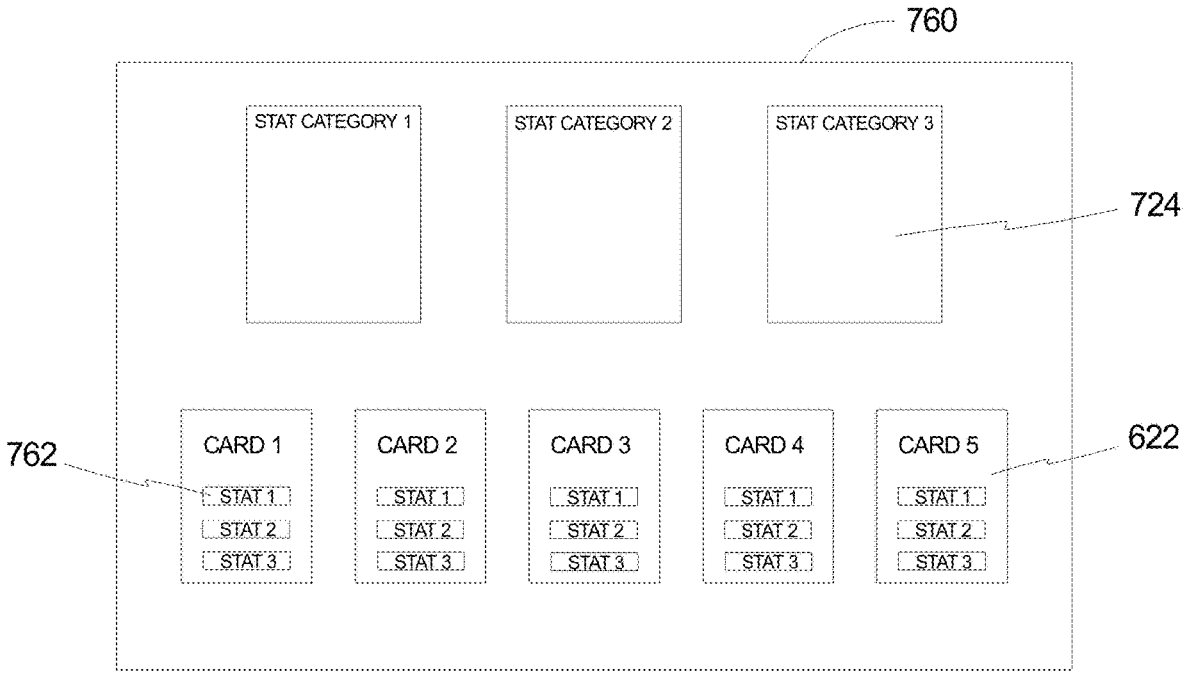
FIG. 7 is a simplified schematic view illustration of still another representative screen image that can be used and/or seen by the player during play of the electronic trading card game.

FIG. 7 is a simplified schematic view illustration of still another representative screen image 760 that can be used and/or seen by the player 214 (illustrated in FIG. 2) during play of the electronic trading card game 210 (illustrated in FIG. 2). As shown in FIG. 7, a plurality of random statistical categories 724 has been displayed which will be used in this individual playing of the electronic trading card game 210. Additionally, the relevant, related statistics 762 are also shown, highlighted or otherwise identified on each of the individual trading cards 622 of the player 214. With such design, it is much easier for the player 214 to isolate the relevant statistics 762 and subsequently choose which trading cards 622 he or she wants to assign to each statistical category 724.

It is understood that the number of random statistical categories 724 that are used within any specific playing of the electronic trading card game 210 can be varied. For example, in one embodiment, as shown in FIG. 7, the individual game play can include three random statistical categories 724. Alternatively, the individual game play can include greater than three or fewer than three random statistical categories 724.

Additionally, it is also appreciated that, as noted above, the random statistical categories 724 can be any suitable statistical categories that have some sort of relevance to the subject of the trading cards 622 within the card pack 520 (illustrated in FIG. 5).

Returning to FIG. 1, at step 111, each player assigns a different trading card from their card pack to each of the random statistical categories. Stated in another manner, in such embodiments, a single trading card cannot be used for more than one of the random statistical categories. In various embodiments, the players will be given a predetermined amount of time within which they must make all of the selections and assignments of different trading cards to each statistical category. For example, in one non-exclusive embodiment, the predetermined amount of time is sixty seconds. Alternatively, the predetermined amount of time can be greater than or less than sixty seconds.

Additionally, in certain embodiments, if the player does not make all of their required selections and assignments within the predetermined amount of time, the game host will proceed to make such selections and assignments on behalf of the player. In some such embodiments, the game host can utilize a specially-designed algorithm that randomly chooses a vacant (i.e. unassigned) statistical category 724 and then chooses the best unused trading card 622 from the available trading cards 622 of that user 214 for that statistical category 724. Such process is continued as necessary until selections of trading cards 622 are made for all statistical categories 724. With such design, each individual playing of the electronic trading card game will be resolved within a reasonable amount of time, i.e. without undue delay. Alternatively, the game host can fill vacant statistical categories 724 in another suitable manner.

In the event that a given live player is playing directly against the game host, i.e. the computer or automated player, the game host will be responsible for making all the required selections of the opposing player, i.e. on behalf of the game host itself. Additionally, in such situations, the algorithm applied by the game host for assigning their own trading cards to each statistical category will be designed to play blind to what the live player has in their own card pack.

Figure 8:
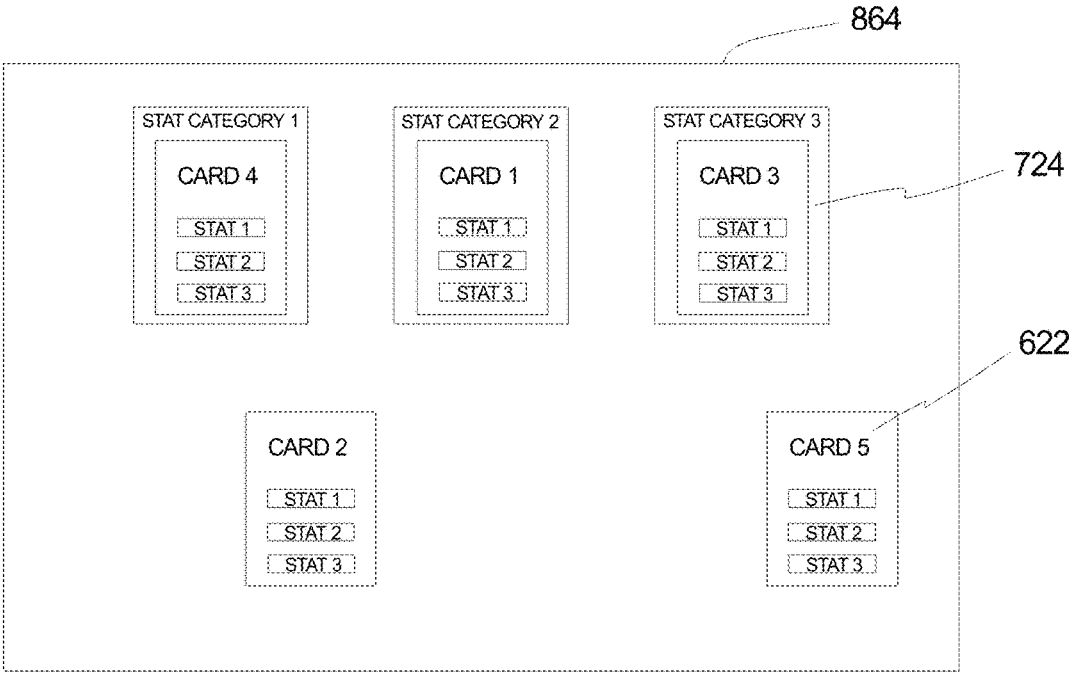
FIG. 8 is a simplified schematic view illustration of another representative screen image that can be used and/or seen by the player during play of the electronic trading card game.

FIG. 8 is a simplified schematic view illustration of another representative screen image 864 that can be used and/or seen by the player 214 (illustrated in FIG. 2) during play of the electronic trading card game 210 (illustrated in FIG. 2). In particular, in FIG. 8, the player 214 has chosen and assigned individual trading cards 622 (or such trading cards 622 have been assigned by the game host 312 (illustrated in FIG. 3) on behalf of the player 214) to be used in the competition for each individual statistical category 724. More particularly, as illustrated in FIG. 8, the player 214 has assigned Card 4 to Stat Category 1, Card 1 to Stat Category 2, and Card 3 to Stat Category 3. With such selections, the Stat 1 value of Card 4 (STAT 4-1) will be used for Stat Category 1, the Stat 2 value of Card 1 (STAT 1-2) will be used for Stat Category 2, and the Stat 3 value of Card 3 (STAT 3-3) will be used for Stat Category 3 by the player 214 in this game.

In certain embodiments, as noted, the player 214 is given a predetermined amount of time, e.g., sixty seconds, in which to select and assign individual trading cards 622 to each individual statistical competition. If the player 214 fails to make the necessary selections within the predetermined amount of time, in some embodiments, the game host 312 itself will assign individual trading cards from amongst the user's trading cards to each statistical competition.

Returning once more to FIG. 1, at step 113, the relevant statistics from the assigned trading cards for each player are displayed and compared for each statistical category.

Figure 9:
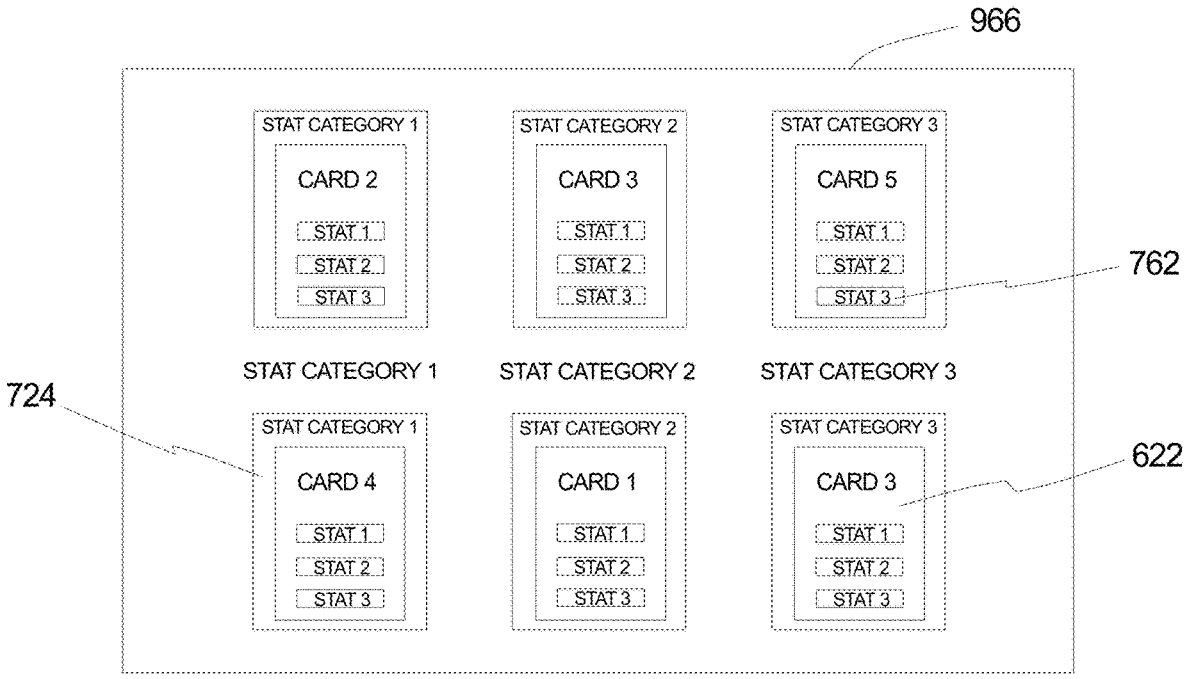
FIG. 9 is a simplified schematic view illustration of yet another representative screen image that can be used and/or seen by the player during play of the electronic trading card game.

FIG. 9 is a simplified schematic view illustration of yet another representative screen image 966 that can be used and/or seen by the player 214 (illustrated in FIG. 2) during play of the electronic trading card game 210 (illustrated in FIG. 2). More specifically, FIG. 9 is a simplified schematic view illustration of the selected trading cards 622 for each player 214 in the competition being positioned near one another as well as a statement of the statistical category 724. It is understood that at this point, each of the players 214 can see the trading cards 622 that have been specifically assigned by all of the players 214 (i.e. themselves and the other players 214 in that particular competition) with the relevant statistics 762 for each trading card 622 appropriately noted.

Returning yet again to FIG. 1, at step 115, a winner (if possible) is determined for each statistical category. As utilized herein, the "winner" of each statistical category is the player whose assigned relevant statistics best match the identified statistical category, e.g., the highest value, lowest value, etc. As such, the "winner" for each statistical category can be said to be the player with the best and/or most relevant statistic. It is appreciated that for each statistical category, the individual competition for each statistical category can result in a win, a loss, or a tie for each of the players.

Additionally, an overall winner for this playing of the electronic trading card game is determined based on which player won more of the statistical categories. In the example as shown in the Figures, i.e. with three random statistical categories, the overall winner is that player which has won the most statistical categories, e.g., best two-out-of-three.

Figure 10:
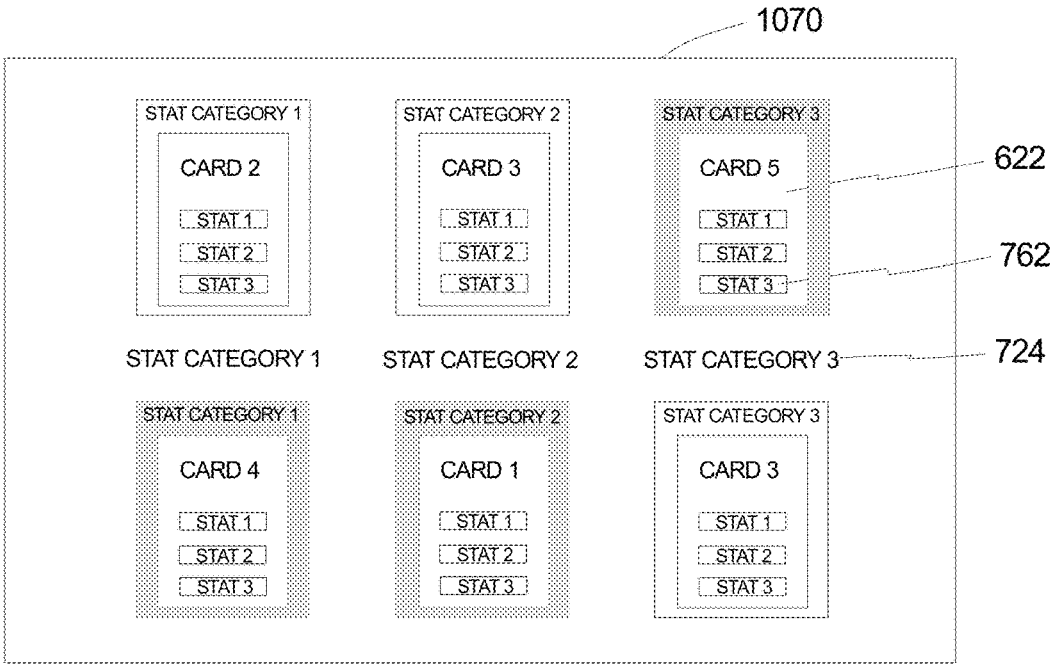
FIG. 10 is a simplified schematic view illustration of another representative screen image that can be used and/or seen by the player during play of the electronic trading card game.

FIG. 10 is a simplified schematic view illustration of another representative screen image 1070 that can be used and/or seen by the player 214 (illustrated in FIG. 2) during play of the electronic trading card game 210 (illustrated in FIG. 2). In FIG. 10, the individual trading cards 622 and relevant statistics 762 for each player 214 have been compared for each statistical category 724, and the winner of each statistical category 724 has been highlighted (e.g., bolded), while the loser of each statistical category 724 has had their trading card 622 turn opaque (or otherwise deemphasized). In the example shown in FIG. 10, the player 214 listed on top has won one statistical category 724, and the player 214 listed on the bottom has won two statistical categories 724.

Returning yet again to FIG. 1, at optional step 117, rules are provided in the event that the normal course of the playing of the electronic trading card game results in an overall tie. In such event, overtime play proceeds with additional statistical categories being added one-by-one, and with each player assigning one of the trading cards from their same card pack to each additional statistical category, i.e. within a predetermined period of time such as sixty seconds, similar to above. Further, similar to above, in the event that a given player does not assign a trading card to the additional statistical category within the predetermined period of time, the game host 312 will again make the selections on behalf of the player in a manner such as described above. The relevant statistics from the trading cards for each player are then displayed and compared for the additional statistical category, and a winner for the additional statistical category as well as an overall winner is determined. It is appreciated that optional step 117 can be repeated for a predetermined number of times, e.g., up to five (5) times, if no overall winner can be determined. More specifically, in certain embodiments, in the event that the comparison for the additional statistical category results in a tie between the players, another additional statistical category will be added and the process will be repeated for the predetermined number of times, e.g., up to five times. If after the predetermined number of tie breaker rounds no overall winner has been determined, in some embodiments, the overall winner can be determined by a random coin flip with each player 214 having a fifty percent (50%) chance of being the overall winner. It is appreciated that the maximum predetermined quantity of five tie breaker rounds is provided merely as an example, and the exact predetermined number of tie breaker rounds before the coin flip commences could be greater than or less than five. Alternatively, in other embodiments, the tiebreaker procedure can be repeated as often as necessary in order to determine an overall winner.

Finally, at step 119, the overall winner of the playing of the electronic trading card game is awarded a bonus reward, e.g., a bonus insert card or other reward or product. More particularly, once a winner is determined, the winner keeps their original card pack while also receiving the bonus reward. On the other hand, the loser of the electronic trading card game keeps their original card pack, but does not receive a bonus reward.

Once the game play has been completed and the bonus reward has been awarded, each of the players are then returned to the game lobby for further game play or for whatever else the player may desire to do within the game lobby.

In certain alternative embodiments, the rewards that are given to the winner and loser of any given competing of the electronic trading card game can be different than what has been specifically described herein.

Figure 11:
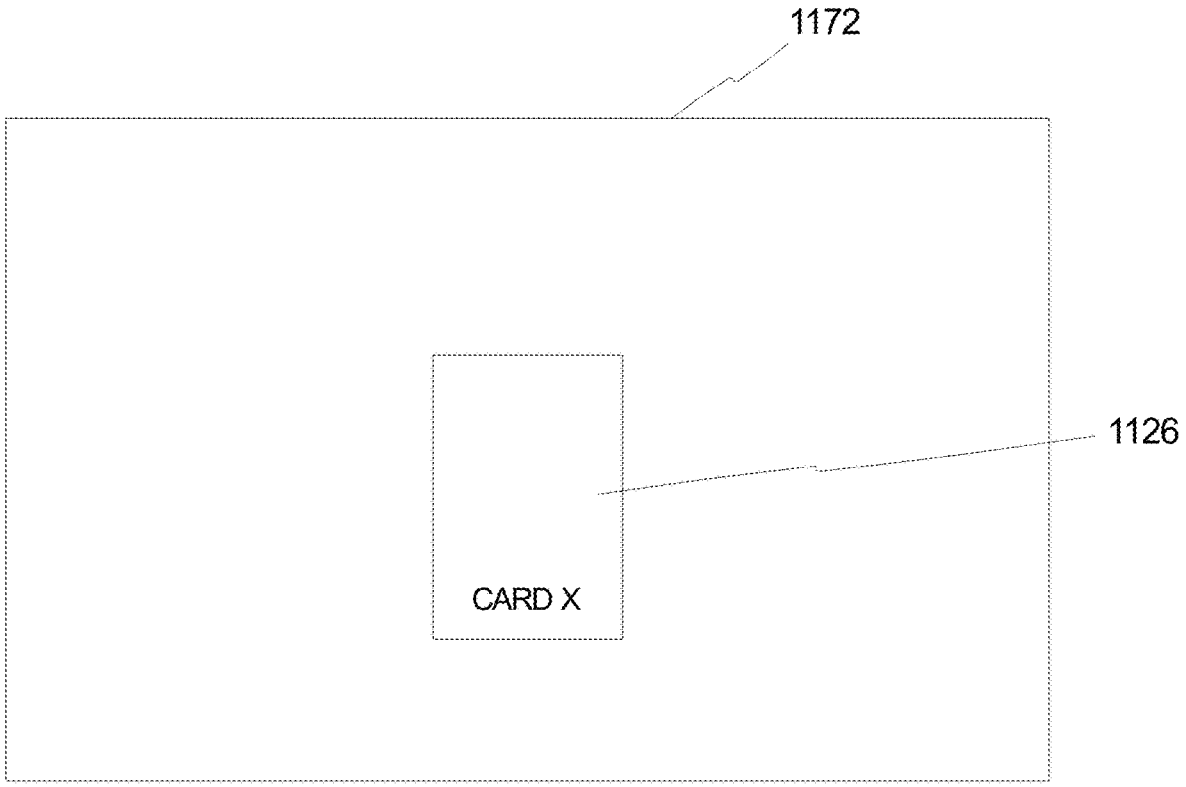
FIG. 11 is a simplified schematic view illustration of still yet another representative screen image that can be used and/or seen by the player during play of the electronic trading card game.

FIG. 11 is a simplified schematic view illustration of still yet another representative screen image 1172 that can be used and/or seen by the player 214 (illustrated in FIG. 2) during play of the electronic trading card game 210 (illustrated in FIG. 2). In particular, FIG. 11 is a simplified schematic view illustration of a randomly awarded bonus reward, e.g., bonus insert card or other reward or product 1126 that has been added to the winning player's collection.

It is understood that although a number of different embodiments of an electronic trading card game 10 have been illustrated and described herein, one or more features of any one embodiment can be combined with one or more features of one or more of the other embodiments, provided that such combination satisfies the intent of the present invention.

While a number of exemplary aspects and embodiments of the electronic trading card game 10 have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. An electronic trading card game being usable for competing in game play between a first player and a second player, the electronic trading card game comprising:

a game host that is accessible to the first player and the second player using a respective computing device via a computing device application, the game host including a processor that is configured to perform the following steps:

providing each of the first player and the second player an unopened pack of trading cards;

opening the pack of trading cards for each of the first player and the second player to reveal individual trading cards from the pack of trading cards for each player only to the respective player;

selecting a plurality of statistical categories that are shown to each of the first player and the second player;

allowing each of the first player and the second player to assign one of the individual trading cards from their respective pack of trading cards to each of the plurality of statistical categories that have been selected;

comparing a relevant statistic included on each of the individual trading cards for each player that has been assigned to each of the plurality of statistical categories, the relevant statistic for each of the individual trading cards being relevant to the statistical category to which the individual trading card has been assigned; and determining a winner for each of the plurality of statistical categories based on which of the individual trading cards assigned to that statistical category has the best relevant statistic.

2. The electronic trading card game of claim 1 wherein the processor is configured to further perform the step of determining an overall winner based on which player wins a greater number of statistical categories.

3. The electronic trading card game of claim 2 wherein the processor is configured to further perform the steps of allowing the overall winner to retain their respective pack of trading cards and awarding the overall winner a bonus reward; and allowing the player who is not the overall winner to retain their respective pack of trading cards.

4. The electronic trading card game of claim 2 wherein if each of the first player and the second player have won the same number of statistical categories, the processor is configured to further perform the steps of (i) selecting an additional statistical category that is shown to each of the first player and the second player; (ii) allowing each of the first player and the second player to assign one of the individual trading cards from their respective pack of trading cards to the additional statistical category; (iii) comparing a relevant statistic included on each of the individual trading cards for each player that has been assigned to the additional statistical category, the relevant statistic for each of the individual trading cards being relevant to the additional statistical category; and (iv) determining a winner for the additional statistical category based on which of the individual trading cards assigned to the additional statistical category has the best relevant statistic.

5. The electronic trading card game of claim 4 wherein the processor is configured to further perform the step of determining the overall winner based on which player wins the additional statistical category.

6. The electronic trading card game of claim 1 wherein the processor is configured to allow the first player and the second player to assign each of the individual trading cards in their respective pack of trading cards to only one of the plurality of statistical categories during game play of the electronic trading card game.

7. The electronic trading card game of claim 1 wherein the processor is configured to allow each of the first player and the second player to assign one of the individual trading cards from their respective pack of trading cards to each of the plurality of statistical categories within a predetermined period of time.

8. The electronic trading card game of claim 7 wherein if either of the first player or the second player fails to assign one of the individual trading cards from their respective pack of trading cards to each of the plurality of statistical categories within the predetermined period of time, the processor is configured to further perform the step of assigning one of the individual trading cards from the pack of trading cards of such player to each of the plurality of statistical categories.

9. The electronic trading card game of claim 1 wherein the game host includes one of an interactive website and an app.

* * * * *